US007611230B2

(12) United States Patent
Nomura et al.

(10) Patent No.: US 7,611,230 B2
(45) Date of Patent: Nov. 3, 2009

(54) INKJET RECORDING APPARATUS

(75) Inventors: Yuko Nomura, Kawasaki (JP); Hitoshi Nagato, Kunitachi (JP); Isao Takasu, Komae (JP); Kenichi Mori, Yokohama (JP); Keiji Sugi, Fujisawa (JP); Tsuyoshi Hioki, Yokohama (JP); Miho Yoda, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 211 days.

(21) Appl. No.: 11/902,882

(22) Filed: Sep. 26, 2007

(65) Prior Publication Data

US 2008/0088668 A1 Apr. 17, 2008

(30) Foreign Application Priority Data

Sep. 27, 2006 (JP) ..... P2006-262223

(51) Int. Cl.
*B41J 2/045* (2006.01)
*B41J 2/135* (2006.01)

(52) U.S. Cl. ..... 347/68; 347/46

(58) Field of Classification Search ..... 347/68, 347/46, 69–72, 54, 56, 62–65, 9, 14, 15; 400/124.16

See application file for complete search history.

(56) References Cited

U.S. PATENT DOCUMENTS 6,045,208 A 4/2000 Hirahara et al.
6,328,421 B1 * 12/2001 Kojima et al. ..... 347/46
6,692,106 B2 * 2/2004 Aizawa et al. ..... 347/46
7,207,651 B2 * 4/2007 Amemiya ..... 347/46

FOREIGN PATENT DOCUMENTS

JP 06-238884 8/1994
JP 08-99408 4/1996

OTHER PUBLICATIONS

Nomura et al.; "Inkjet Recording Apparatus", U.S. Appl. No. 11/902,445, filed Sep. 21, 2007.

* cited by examiner

*Primary Examiner*—K. Feggins
(74) *Attorney, Agent, or Firm*—Finnegan, Henderson, Farabow, Garrett & Dunner, L.L.P.

(57) ABSTRACT

An inkjet recording apparatus includes: a head unit including: an ultrasonic wave generation unit that generates ultrasonic waves; an ultrasonic wave focus unit that focuses the ultrasonic waves to an ultrasonic wave focus position; an ultrasonic wave transmission unit that propagates the ultrasonic waves from the ultrasonic wave focus unit; and a wall plate that covers the ultrasonic wave generation unit, the ultrasonic wave focus unit and the ultrasonic wave transmission unit; an annular film that rotates while sliding along an exterior of the head unit; a film drive mechanism that rotates the film; and an ink application unit that applies ink over the film to form an ink layer, wherein the ultrasonic wave focus position of the head unit is directing to a position of the ink layer so as to eject an ink from the ink layer.

12 Claims, 11 Drawing Sheets

INKJET RECORDING APPARATUS

The entire disclosure of Japanese Patent Application No. 2006-262223 filed on Sep. 27, 2006, including specification, claims, drawings and abstract is incorporated herein by reference in its entirety.

BACKGROUND OF THE INVENTION

1. Field of the Invention

The present invention relates to an inkjet recording apparatus for recording an image on a recording medium by ejecting ink droplets. Particularly, the present invention relates to an inkjet recording apparatus which ejects ink droplets by generating ultrasonic waves from an ultrasonic wave generation element and focusing the ultrasonic waves.

2. Description of the Related Art

An inkjet recording apparatus which records an image on a recording medium by ejecting liquid ink in the form of minute droplets has many advantages; for example, the capability of recording an image directly on plain paper, the capability of curtailing cost in terms of consumption of materials such as ink; low noise; and obviation of a necessity for processing such as development, fixing, and the like. Therefore, the inkjet recording apparatus has recently spread into wider application areas; for example, industrial fields such as application of liquid electronic materials, direct patterning, as well as in an office automation field.

Many mechanisms have already been contrived as the inkjet recording apparatus. Particularly typical mechanisms include a mechanism for ejecting droplets by utilization of pressure of bubbles generated by heat of a heating element, a mechanism for ejecting droplets by pressure pulses stemming from displacement of a piezoelectric element, and the like.

However, the pieces of inkjet recording apparatus having these mechanisms suffer a problem of condensation of ink being readily caused by evaporation or volatilization of a solvent of liquid ink and a problem of use of a nozzle of small bore resulting in occurrence of clogging which hinders ejecting of ink droplets. For these problems, image recording of particularly high definition requires provision of an additional unit for cleansing a nozzle to prevent occurrence of clogging of the nozzle. The range of usage of such an inkjet recording apparatus is confined because of a necessity for selectively using an ink material which causes less clogging.

In contrast, there has been proposed an inkjet recording apparatus of an acoustic mechanism for focusing ultrasonic waves stemming from a transducer and ejecting ink droplets from an ink reservoir level by sound pressure of the ultrasonic waves. This mechanism has an advantage of obviation of a necessity for a nozzle, the capability of ejecting ink droplets of very small diameter, the adaptability of the recording apparatus to higher resolution, and few restrictions on available ink materials.

However, highly-viscous ink such as that used for industrial applications generally involves great attenuation of ultrasonic waves and requires great power to eject ink. Further, in the case of ink of excessively-high viscosity, there arises a problem of a failure to eject ink. Fluctuations in the level of ink induce displacement in the position (an ultrasonic wave focus position) where the ultrasonic waves originating from the transducer are to be focused, thereby resultantly raising a problem of a failure to eject ink. In such a case, a mechanism for adjusting a head position to address the fluctuations in the level is required, which in turn results in complication of the recording apparatus. For avoiding such a problem, a technique for rendering an ink layer thin by use of a substance which propagates ultrasonic waves to an ultrasonic wave propagation path has been put forward, as disclosed in JP-A-6-238884.

According to the technique described in connection with JP-A-6-238884, ink must be fed to a thin layer. Hence, difficulty is encountered in feeding highly-viscous ink to a narrow clearance. Further, since there are many orifices, difficulty is also encountered in causing ink to flow over the head. In addition, the head can be oriented upward, but countermeasures must be taken against leakage of ink when the head is oriented downward, because of the plurality of orifices. Structurally, extreme difficulty is encountered in regulating the flow rate of ink when the head is oriented horizontally, because of a difference in pressure between an upper portion of the ink and a lower portion of the same.

SUMMARY OF THE INVENTION

The invention may provide an inkjet recording apparatus including: a head unit including: an ultrasonic wave generation unit that generates ultrasonic waves; an ultrasonic wave focus unit that focuses the ultrasonic waves to an ultrasonic wave focus position; an ultrasonic wave transmission unit that propagates the ultrasonic waves from the ultrasonic wave focus unit; and a wall plate that covers the ultrasonic wave generation unit, the ultrasonic wave focus unit and the ultrasonic wave transmission unit; an annular film that rotates while sliding along an exterior of the head unit; a film drive mechanism that rotates the film; and an ink application unit that applies ink over the film to form an ink layer, wherein the ultrasonic wave focus position of the head unit is directing to a position of the ink layer so as to eject an ink from the ink layer.

BRIEF DESCRIPTION OF THE DRAWINGS

Embodiment may be described in detail with reference to the accompanying drawings, in which.

DETAILED DESCRIPTION OF THE INVENTION

First Embodiment

Figure 1:
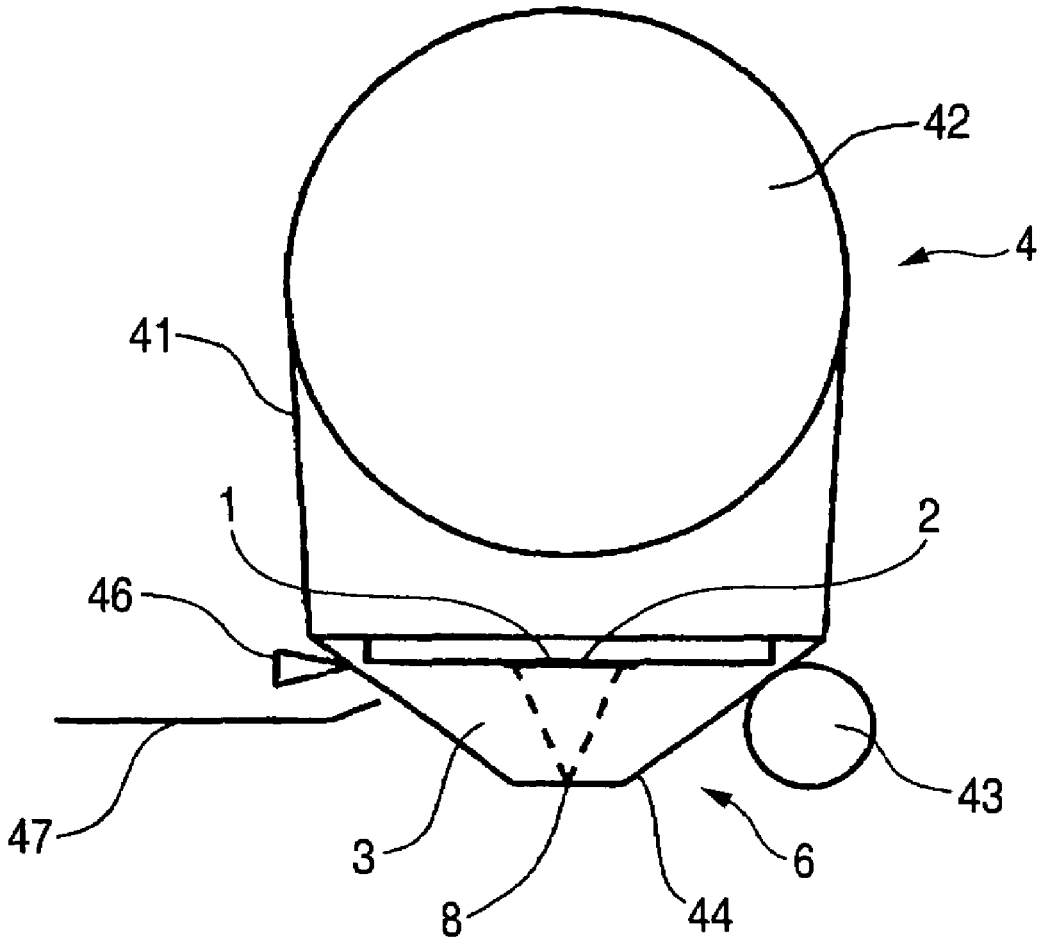
FIG. 1 is a cross-sectional view of an inkjet recording apparatus according to a first embodiment of the present invention.
Figure 2:
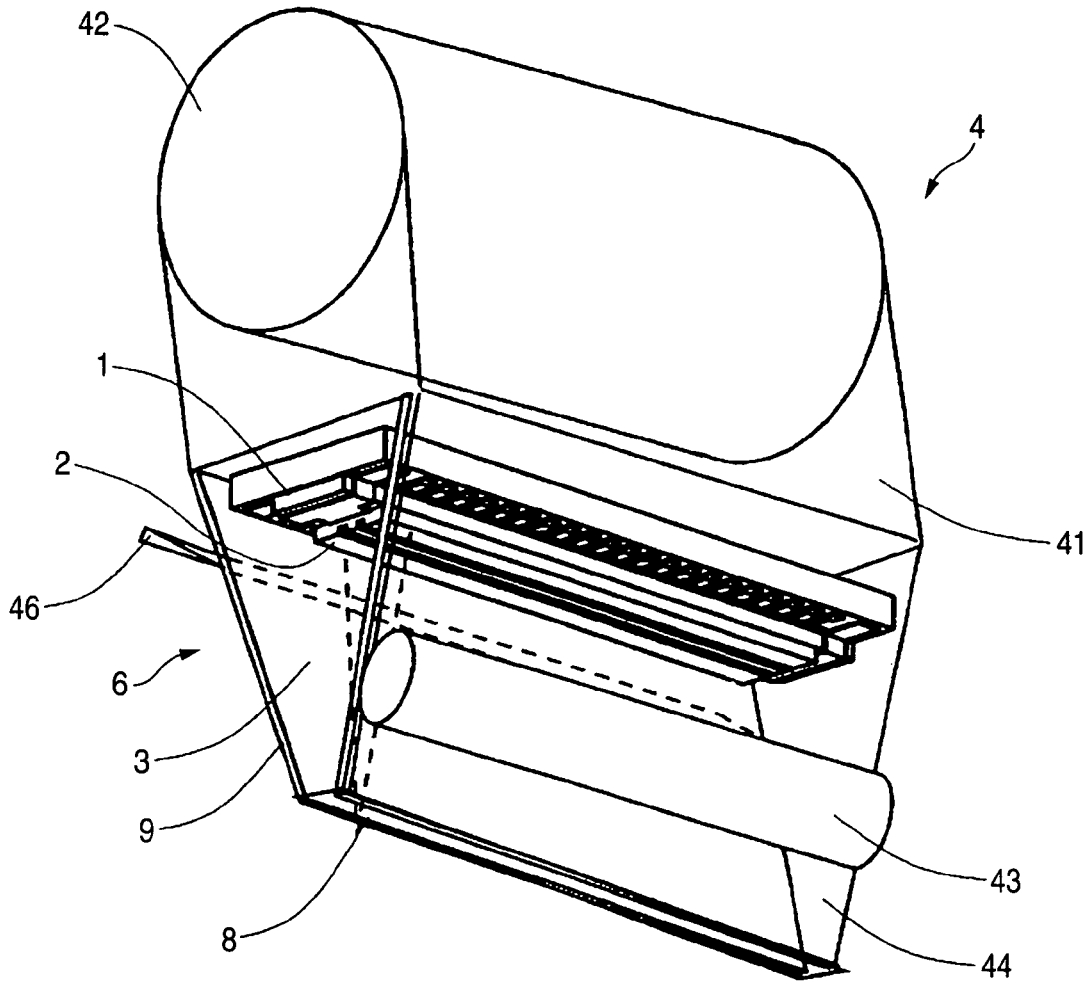
FIG. 2 is a perspective view of the inkjet recording apparatus shown in FIG. 1.
Figure 3:
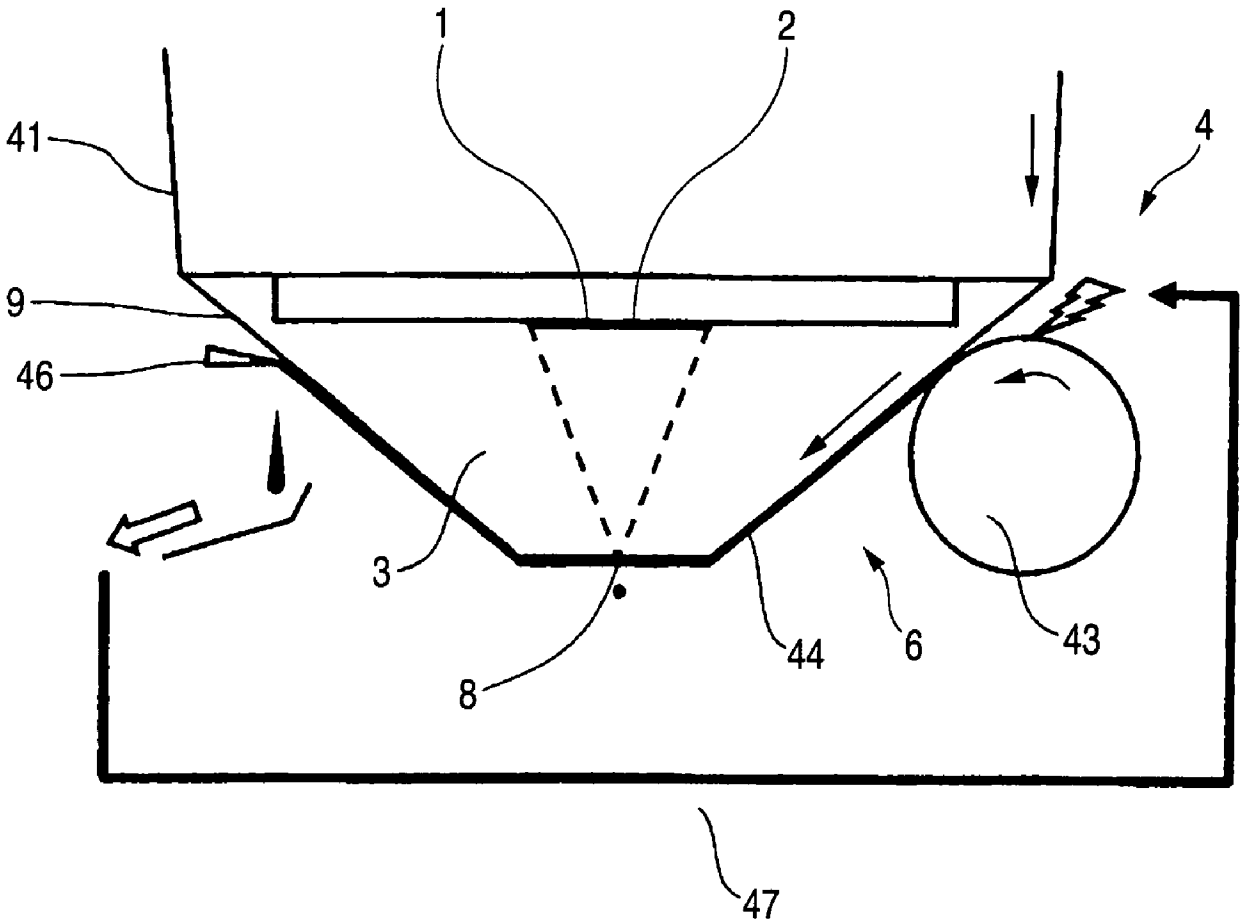
FIG. 3 is an enlarged cross-sectional view of a neighborhood of a head unit of the inkjet recording apparatus shown in FIG. 1.

By reference to FIGS. 1 through 3, a first embodiment of an inkjet recording apparatus of the present invention will be described. FIG. 1 is a cross-sectional view of the inkjet recording apparatus of the first embodiment; FIG. 2 is a perspective view of this inkjet recording apparatus; and FIG. 3 is an enlarged cross-sectional view of a neighborhood of a head unit of this inkjet recording apparatus.

The inkjet recording apparatus of the present embodiment has a head unit 6 and an ink supply unit 4 for supplying ink. The head unit 6 has an ultrasonic wave generation unit 1, an ultrasonic wave focus unit 2, an ultrasonic wave transmission unit 3, and a wall plate 9 whose shape is fixed and which covers these units. The ink supply unit 4 has an annular film 41 which rotates, in a slidable manner, along an outer periphery of the head unit 6; a drive roller 42 for rotating the film 41; and an ink application unit 43 for applying ink to an exterior of the film 41. The inkjet recording apparatus of the present embodiment also has an ink recovery unit 46 for recovering unejected ink from the film 41; and an ink recycle unit 47 for recycling the ink recovered by the ink recovery unit 46 by supplying the ink to the ink application unit 43.

Details of each of the units will now be described. First, details of the head unit 6 will be described.

The ultrasonic wave generation unit 1 is formed from piezoelectric elements and electrodes which are arranged in a one-dimensional array. Piezoelectric ceramics such as lead-zirconate-titanate (PZT), lead titanate, barium titanate, or the like; a piezoelectric monocrystal such as lithium niobate, lithium tantalate, or the like; a macromolecular piezoelectric element such as polyvinylidene difluoride (PVDF), or the like; and a piezoelectric semiconductor such as zinc oxide, can be used as the piezoelectric element. An unillustrated drive circuit for driving the ultrasonic wave generation unit 1 is connected to the electrode, and the drive circuit actuates the piezoelectric element according to image record data sent from the outside, to thus generate ultrasonic waves.

The ultrasonic wave focus unit 2 plays a role of focusing the ultrasonic waves generated by the ultrasonic wave generation unit 1 at an ultrasonic wave focus position 8. A plane Fresnel lens created by grooving glass is used in the present embodiment. A meniscus is formed in the ink level under the pressure of the focused acoustic beam, and a droplet is separated and ejected. For instance, an inorganic material such as glass or the like, an epoxy resin, or the like, can be used as a material of the ultrasonic wave focus unit 2. The durability of a material can be enhanced by subjecting the surface of glass or a resin to surface treatment; for example, by plating the surface with a metallic film, a metallic oxide film, a nitride film, a polyolefin-based resin film, or the like. An acoustic impedance of the ultrasonic wave focus unit 2 corresponds to a median value of an acoustic impedance (ZP) of the piezoelectric element used in the ultrasonic wave generation unit 1 and an acoustic impedance (ZL) of the ultrasonic wave transmission unit 3. The acoustic impedance of the ultrasonic wave focus unit 2 being close to a geometrical average [$\sqrt{(ZP \cdot ZL)}$] of the acoustic impedances is desirable for efficient propagation of ultrasonic waves.

A phased array head and a drive method that are similar to the related art can be used in this embodiment.

The ultrasonic wave transmission unit 3 is an area that propagates ultrasonic waves that have been generated by the ultrasonic wave generation unit 1 and are being focused by the ultrasonic wave focus unit 2 propagate; and is filled with an ultrasonic wave transmission substance. A substance entailing small attenuation of ultrasonic waves is preferable as the ultrasonic wave transmission substance; for instance, a liquid such as water is preferable.

The wall plate 9 forms a surrounding area of the head unit 6 and has a fixed shape so as to cover the ultrasonic wave generation unit 1, the ultrasonic wave focus unit 2, and the ultrasonic wave transmission unit 3. No specific limitation is imposed on the material of the wall plate 9, but a material which does not reflect ultrasonic waves is desirable. Moreover, the head unit 6 assumes a tapered polygonal shape in FIG. 1. No particular limitations are imposed on the shape of the head unit, so long as the head unit is larger than a propagation path for acoustic sounds. A neighborhood area of the ultrasonic wave focus position 8 of the wall plate 9 desirably becomes thin such that ultrasonic waves readily pass through that area.

Next, the ink supply unit 4 will be described in detail.

The film 41 is an annularly-closed seamless film, and rotates while remaining in contact with a portion of the outer periphery of the head unit 6. No specific limitations are imposed on the thickness of the film 41, but the thickness of the film preferably complies well with the shape of the head unit 6. A thickness of 100 μm or less is desirable. Although no specific limitations are imposed on the material of the film, a substance exhibiting superior resistance to a solvent, such as polyimide or the like, is preferable. Moreover, when a limitation is imposed on ink to be used, an ink material exhibiting superior wettability with ink (a contact angle between ink and the film is 90° or less) is more desirable, in view that the thickness of a liquid film can be maintained constant without repulsion of ink.

The film 41 is rotated by the drive roller 42. In order to effect stable driving, the drive roller 42 is required to exhibit high friction against the film 41, and hence the drive roller 42 is preferably made from rubber. Moreover, in order to maintain stable driving, the drive roller 42 requires hardness of such an extent that the shape of the drive roller does not change during rotation. With a view toward preventing meandering of the film 41, ribs are preferably provided at respective ends of the drive roller 42, or the drive roller 42 is preferably given a barreled shape whose center diameter is made larger than the diameter of both ends. (A drawing of the barreled shape is omitted). Moreover, in order to prevent the film 41 from being cut by an edge portion of the head unit 6, angular portions of the head unit 6 are preferably rounded, or the diameter of the drive roller 42 is preferably made larger than the diameter of the head unit 6.

The ink application unit 43 forms an ink layer by applying ink over the film. A rotatable roller is used as the ink application unit. The ink application unit 43 may also have an additional unit for supplying ink to the ink application roller. Alternatively, the ink application roller may also be formed from a porous material such that ink seeps from the inside of the roller. The inkjet recording apparatus of the present embodiment is configured such that ink is ejected by causing the ultrasonic wave focus position 8—where the ultrasonic waves generated by the ultrasonic wave generation unit 1 are to be focused—to match an ink layer 44 applied over the film 41 by the ink application unit 43.

Desirable viscosity of ink applied by the ink application unit 43 is such that ink does not flow over the film. For instance, a preferable viscosity is 100 mPa·s or more according to a measurement method specified by the International database for certified reference materials (COMAR). When the viscosity is equal to or less than this level, ink flows over the film 41, and difficulty is encountered in maintaining a uniform ink layer 44. For instance, liquid silicone rubber (manufactured by GE Toshiba: YE5822) or liquid silicone rubber (manufactured by GE Toshiba: TSE3033) can also be used as a solvent of ink. YE5822 and TSE3033 assume a viscosity of 1000 mPa·s or thereabouts. This viscosity was measured by use of a viscosity-elastiviscosity measurement apparatus (manufactured by HAAKE Gmbh; Rheostress). Both liquid silicone rubbers were ascertained to be able to form a superior ink layer 44 on a polyethylene terephthalate film.

A scraper having unsharpened extremity so as not to inflict damage on the film 41, or a like scraper, can be used as the ink recovery unit 46. No particular limitations are imposed on the material of the scraper or the like. However, when great friction arises between the ink recovery unit 46 and the film 41, stable driving cannot be achieved. Hence, metal or rubber having a low coefficient of friction is preferable.

By use of the ink recovery unit 46, the ink recycle unit 47 recovers the ink removed from the film, and again supplies the ink application unit 43 with the thus-recovered ink. Although not illustrated, the ink recycle unit 47 may also perform processing for storing the ink recovered by the ink recovery unit 46 and leaving the thus-recovered ink (e.g., agitation, addition of an additive, or filtration of aggregates or impurities) uncondensed, or like processing. Moreover, the ink recycle unit 47 may be of reuse type which adds new ink to the recovered ink.

Although FIG. 3 illustrates a system for recovering ink from the film 41 and recycling the thus-recovered ink, the ink application unit 43 may additionally apply ink over the ink-coated film 41 without recovering ink, to thus form a new ink layer 44 and eject ink.

The inkjet recording apparatus of the present embodiment is configured to transport the ink-coated film to the ultrasonic wave focus position. Hence, problems such level fluctuations as those mentioned previously do not arise. Therefore, a necessity for a mechanism for adjusting a head position to cope with level fluctuations is obviated, and miniaturization of the recording apparatus becomes feasible. As mentioned previously, the recording apparatus is configured so as to transport to the ultrasonic wave focus position the ink thin layer formed by application of a small quantity of ink to the film, whereby attenuation of ultrasonic waves caused by highly-viscous ink is lessened and the problem of a failure to eject ink or the like can be resolved. Thus, stable ejecting of ink can be realized. Moreover, the ink applied by the ink application unit is adjusted to a viscosity at which ink does not flow over the film [preferably 100 mPa·s or more under the measurement method specified by the International database for certified reference materials (COMAR)]. As a result, flow of ink over the film is prevented, and hence an ejecting direction can be set to an arbitrary direction (e.g., downward ejecting or the like). As a result of provision of the ink recovery unit for recovering the ink applied over the film and the ink recycle unit for recycling the thus-recovered ink, there can be provided an inkjet recording apparatus exhibiting efficient use of ink.

Second Embodiment

Figure 4:
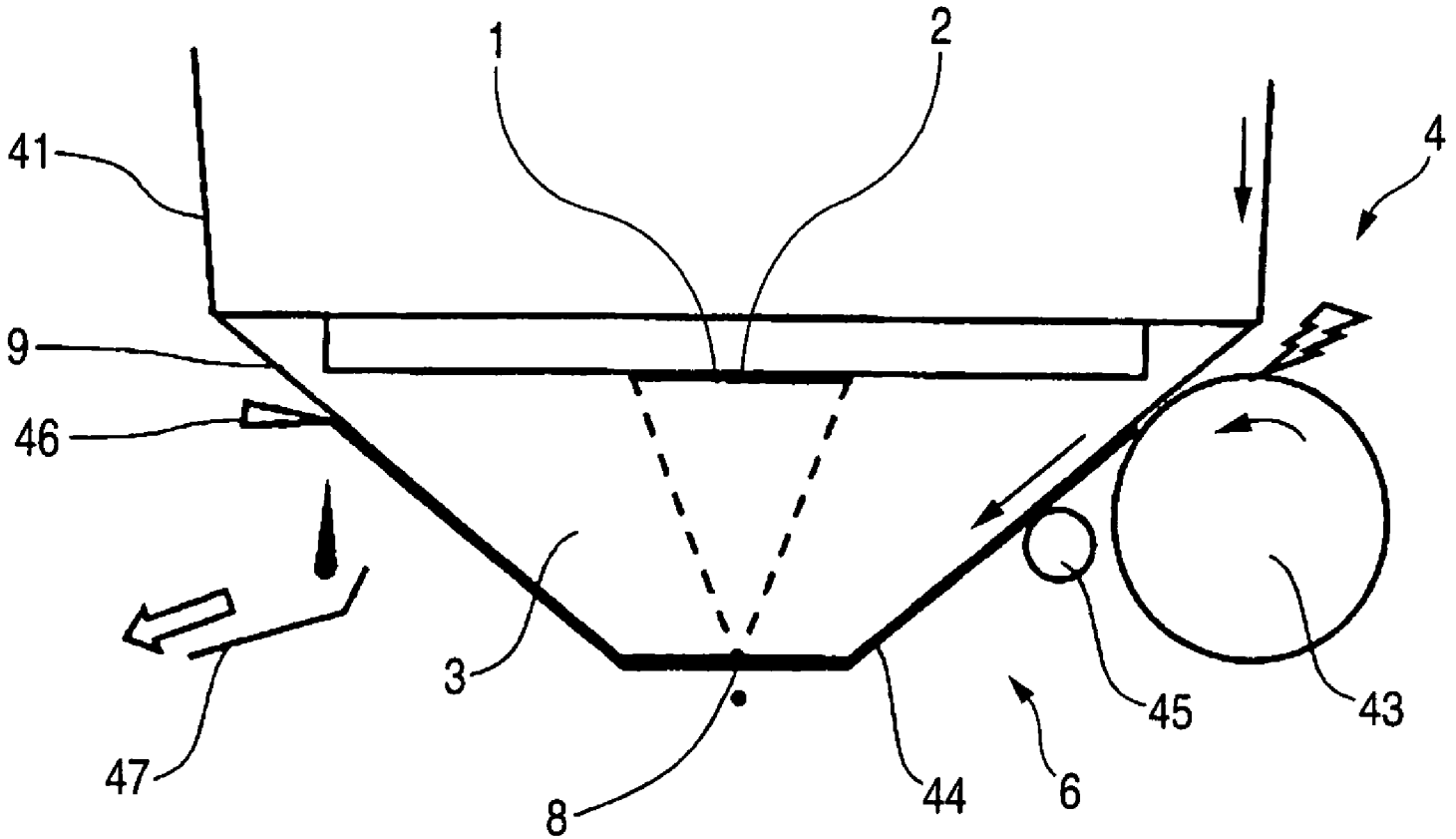
FIG. 4 is an enlarged cross-sectional view of a neighborhood of a head unit of the inkjet recording apparatus according to a second embodiment of the present invention.

A second embodiment of the inkjet recording apparatus of the present invention will be described by reference to FIG. 4. FIG. 4 is an enlarged cross-sectional view of a neighborhood of a head unit of the inkjet recording apparatus of the second embodiment. Those elements which are identical with or analogous to those of the first embodiment are assigned common reference numerals, and their repeated explanations are omitted.

The inkjet recording apparatus of the present embodiment is additionally provided with an ink layer adjustment unit 45 for rendering uniform the ink layer 44 formed over the film 41 by the ink application unit 43. Use of the ink layer adjustment unit 45 enables stable supply of the ink layer of specified thickness at all times. For instance, rotatable rollers spaced apart from the film 41 can be used as the ink layer adjustment unit 45. Alternatively, a blade (not illustrated) spaced away from the film 41 by a distance corresponding to the thickness of the ink layer 44 can also be used. Regardless of a shape of the ink layer adjustment unit; e.g., the shape of a roller or a blade, a substance resistant to sticking of ink, e.g., a fluororesin [e.g., Teflon (Trade Name)] is preferably used for the ink layer adjustment unit 45.

As in the case of the first embodiment, the ink recycle unit 47 may be optionally provided.

In addition to yielding the advantage described in connection with the first embodiment, the inkjet recording apparatus of the present embodiment yields an advantage of the ability to stably supply an ink layer of specified thickness at all times. Therefore, more stable ejecting of ink becomes feasible.

Third Embodiment

Figure 5:
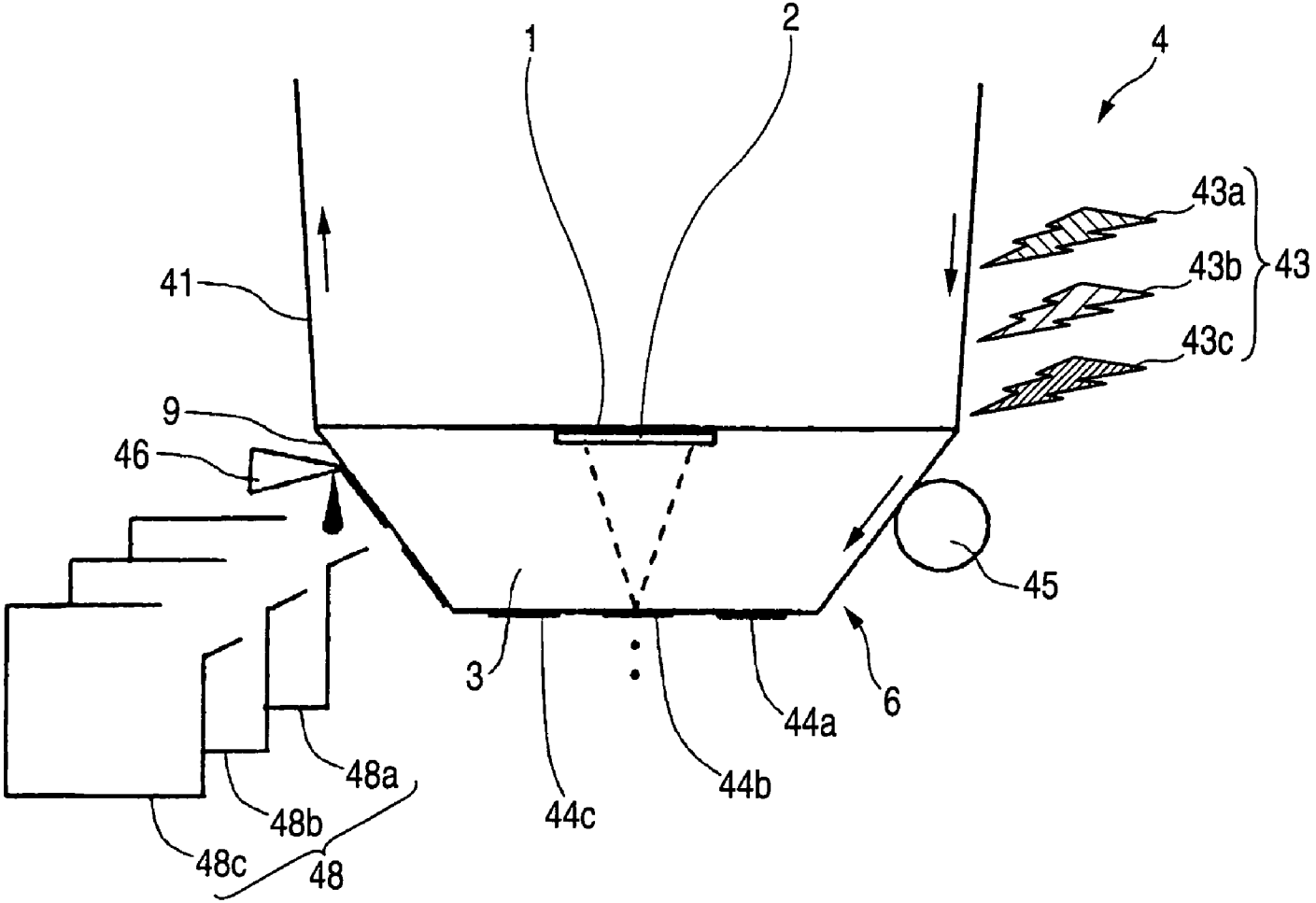
FIG. 5 is an enlarged cross-sectional view of a neighborhood of a head unit of the inkjet recording apparatus according to a third embodiment of the present invention.
Figure 6:
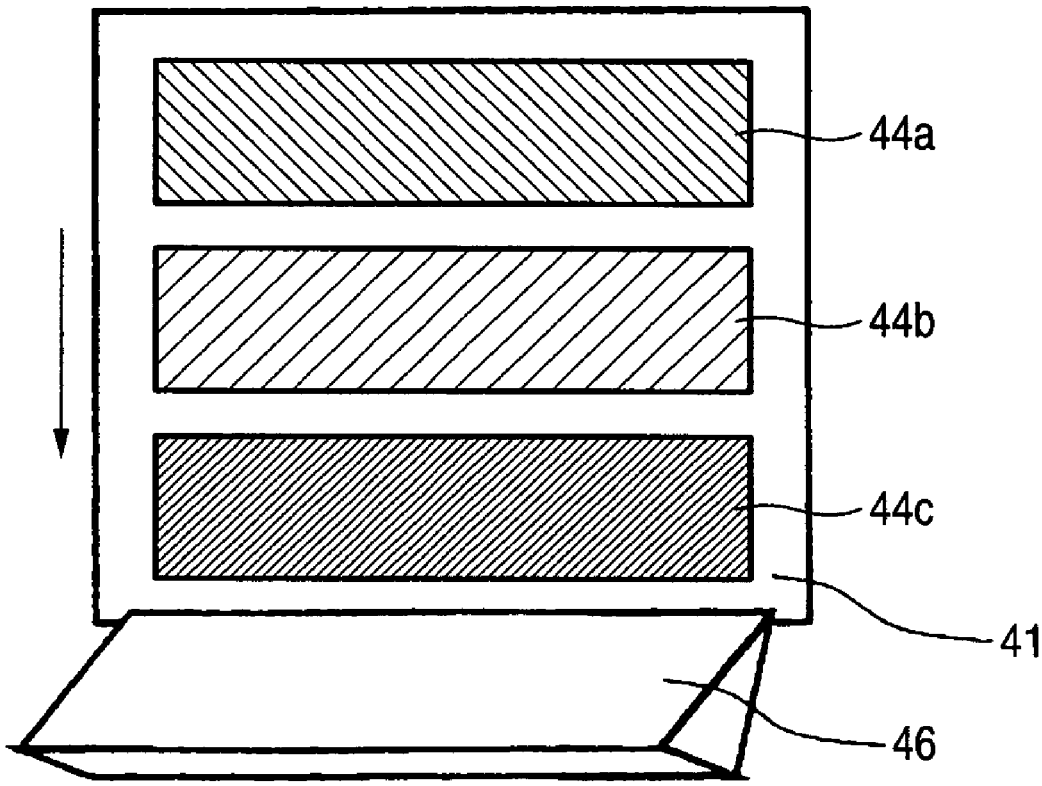
FIG. 6 is a diagrammatic perspective view showing an example layout of various ink layers on a film and an example layout of a scraper in the third embodiment.
Figure 7:
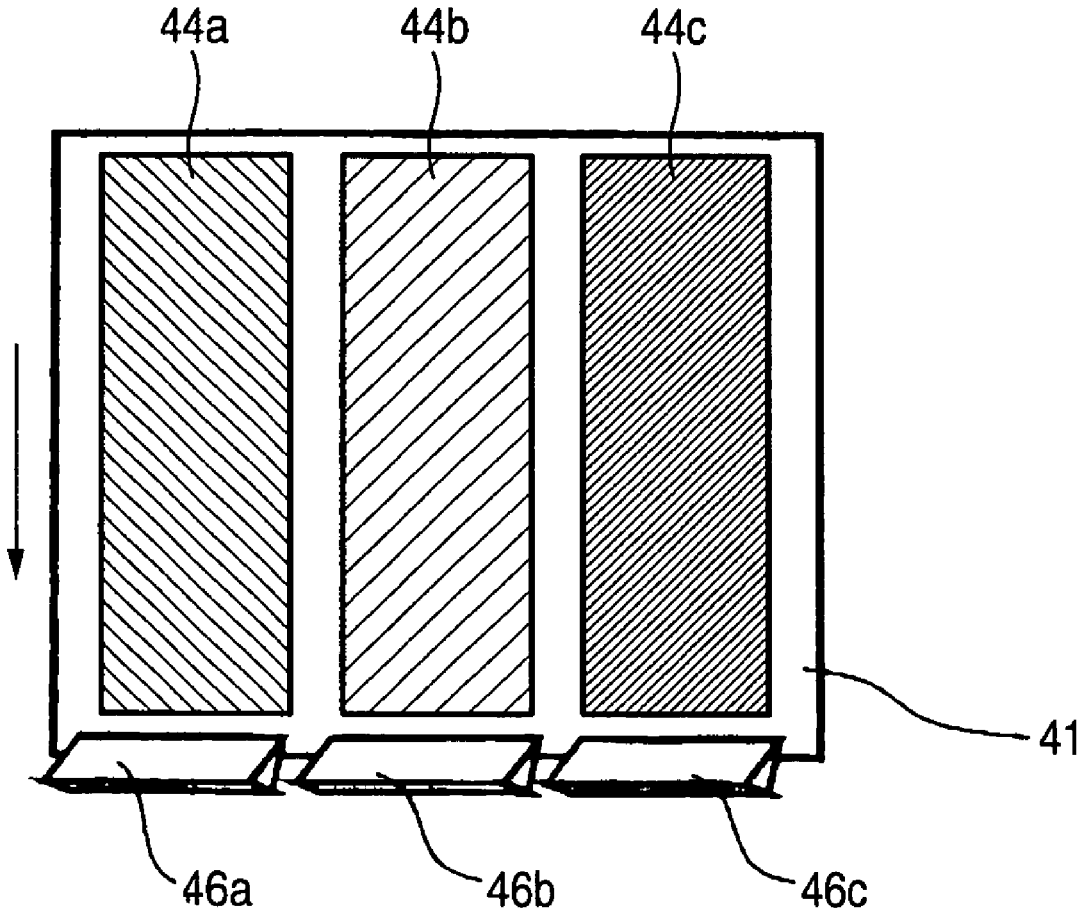
FIG. 7 is a diagrammatic perspective view showing another example layout of various ink layers on a film and another example layout of scrapers in the third embodiment, which are different from the examples shown in FIG. 6.
Figure 8:
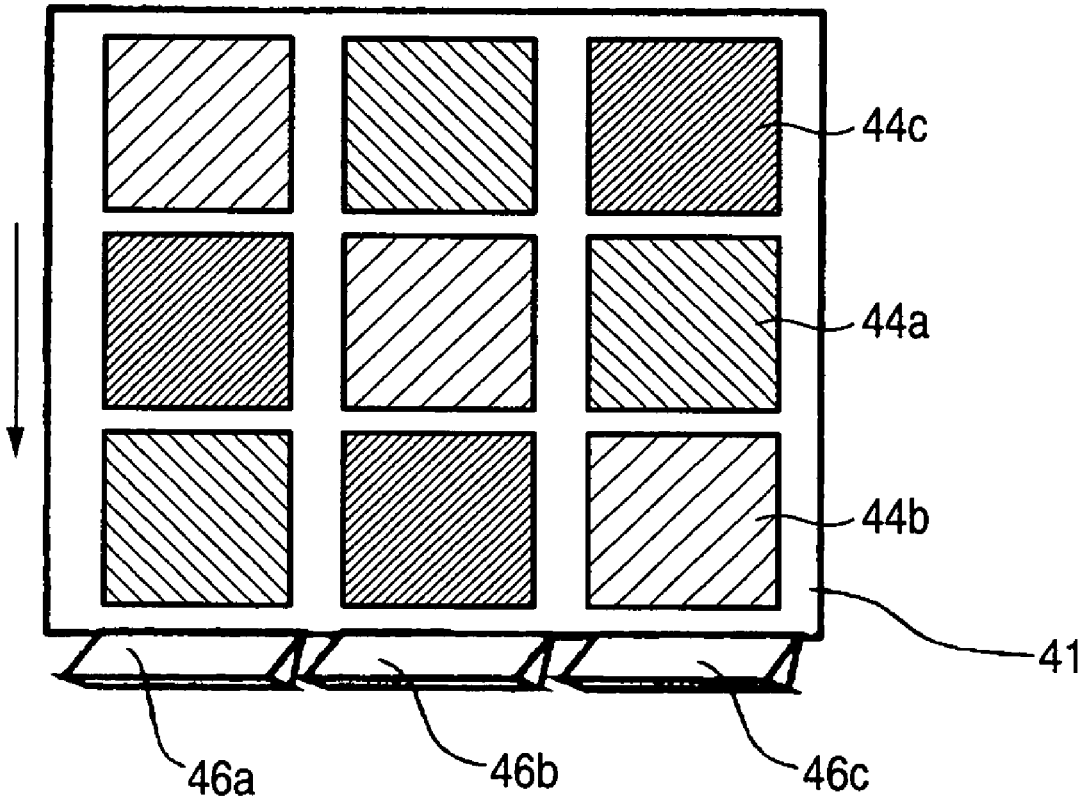
FIG. 8 is a diagrammatic perspective view showing still another example layout of various ink layers on a film and still another example layout of scrapers in the third embodiment, which are different from the examples shown in FIGS. 6 and 7.

A third embodiment of the inkjet recording apparatus of the present invention will be described by reference to FIGS. 5 through 8. FIG. 5 is an enlarged cross-sectional view of a neighborhood of a head unit of the inkjet recording apparatus of the third embodiment. FIGS. 6 through 8 are schematic perspective views showing example layouts of ink layers of various types on a film and example layouts of a scraper, and each of the drawings shows a different example.

The third embodiment is a modification of the second embodiment. Those elements which are identical with or analogous to those of the second embodiment are assigned common reference numerals, and their repeated explanations are omitted.

In the inkjet recording apparatus of the present embodiment, ink of a plurality of types is applied over the film 41 by a plurality of ink application units 43*a*, 43*b*, and 43*c* (three application units in the embodiment shown in FIG. 5). The ink layer adjustment unit 45 renders uniform the ink applied by the ink application unit 43*a*, 43*b*, and 43*c*. In the present embodiment, the ink layer adjustment unit 45 is common to ink layers 44*a*, 44*b*, and 44*c* of respective types. Hence, providing a cleaning unit (not shown) formed from an elastic member (e.g., a blade or a sponge) or nonwoven fabric so as to avoid intrusion of impurities into ink is preferable. A plurality of ink layer adjustment units 45 corresponding to the ink application units 43*a*, 43*b*, and 43*c* may also be provided.

The ink recovery unit 46 is analogous to that described in connection with the second embodiment. However, in order to recycle, the ink recovery unit must have recovered-ink tanks 48*a*, 48*b*, and 48*c* assigned to respective types of ink. Although in FIG. 5 the ink recovery unit (scraper) 46 is equipped with only one recovered-ink tank, recovered-ink tanks may also be prepared in equal number to the types of ink.

FIG. 6 schematically shows an example of divided application of three types of ink. When the ink application units 43*a*, 43*b*, and 43*c* are arranged in the longitudinal direction of rotation of the film 41 as shown in FIG. 5, the ink layers 44*a*, 44*b*, and 44*c* corresponding to respective types of ink are formed in the shape of a strip along the widthwise direction of the film 41 (i.e., a direction perpendicular to the longitudinal direction of rotation of the film) as shown in FIG. 6. In this case, in order to individually recover ink of three types, the three recovered-ink tanks 48*a*, 48*b*, and 48*c* are removably attached at appropriate timings. At this time, one scraper 46 can handle all of the ink layers 44*a*, 44*b*, and 44*c*. However, there are preferably provided a cleaning unit (not shown) for removing the ink adhering to the scraper 46, at a timing corresponding to replacement of the recovered-ink tanks 48*a*, 48*b*, and 48*c*.

FIG. 7 diagrammatically shows another example of divided application of three types of ink, which is different from the example shown in FIG. 6. This is a case where the ink application units 43*a*, 43*b*, and 43*c* (shown in FIG. 5) are arranged side by side in the widthwise direction of the film 41. In this case, ink recovery units (scrapers) 46*a*, 46*b*, and 46*c* matching the respective widths of the ink layers 44*a*, 44*b*, and 44*c* assigned to respective types of ink are arranged in a widthwise direction so as to correspond to the positions of the ink layers 44*a*, 44*b*, and 44*c*. The recovered-ink tanks 48*a*, 48*b*, and 48*c* are arranged side by side in the widthwise direction of rotation of the film and in alignment with the respective positions of the scrapers 46*a*, 46*b*, and 46*c*, thereby obviating a mechanism for removably attaching and moving the recovered-ink tanks 48*a*, 48*b*, and 48*c*. Therefore, the structure of the recording apparatus is simplified.

FIG. 8 diagrammatically shows yet another example of divided application of three types of ink, which is different from the examples shown in FIGS. 6 and 7. This example corresponds to a case where the ink application units 43*a*, 43*b*, and 43*c* (see FIG. 5) are positioned in the form of a lattice (a grid pattern) with respect to the longitudinal and widthwise directions of rotation of the film 41. In this case, a moving unit for moving the recovered-ink tanks 48*a*, 48*b*, and 48*c* for recovering ink is required. Moreover, provision of a cleaning unit for the scrapers 46*a*, 46*b*, and 46*c* is preferable. In this case, the mechanism of the recording apparatus becomes complicated, but the degree of freedom of patterning of a recording medium is considerably increased.

Figure 9:
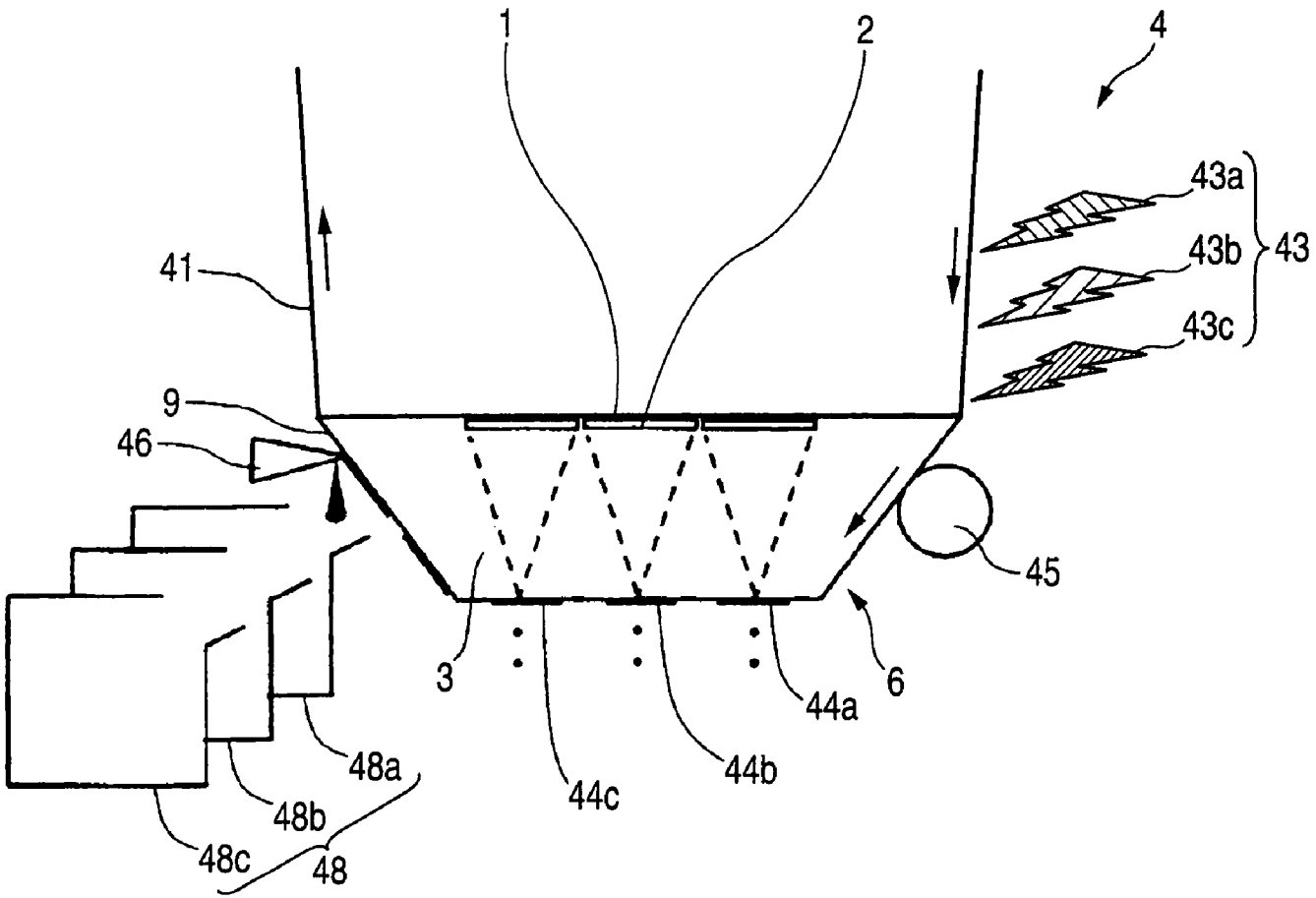
FIG. 9 is an enlarged cross-sectional view of a neighborhood of a head unit according to a modification of the inkjet recording apparatus according to the third embodiment of the present invention.

FIG. 9 shows a modification of the third embodiment shown in FIG. 5, wherein a plurality of sets, each set consisting of the ultrasonic wave generation unit 1 and the ultrasonic wave focus unit 2, are arranged side by side in the longitudinal direction of the rotation of the film 41. By such a configuration, a print speed can be increased efficiently. Moreover, the plurality of sets, each set consisting of the ultrasonic wave generation unit 1 and the ultrasonic wave focus unit 2, may also be arranged side by side in the widthwise direction of the film 41 (not shown).

The system for recovering ink from the film 41 and recycling the thus-recovered ink is illustrated herein. When ink is applied in a divided manner as shown in FIG. 7, it may be the case that ink is not recovered, and ink is additionally applied over the ink-coated film 41 by the ink application unit 43*a*, 43*b*, and 43*c*, to thus newly create ink layers 44*a*, 44*b*, and 44*c* and eject ink.

According to the inkjet recording apparatus of the present embodiment, there can be provided an inkjet recording apparatus capable of applying ink of a plurality of colors in addition to yield the advantage described in connection with the first embodiment.

Fourth Embodiment

Figure 10:
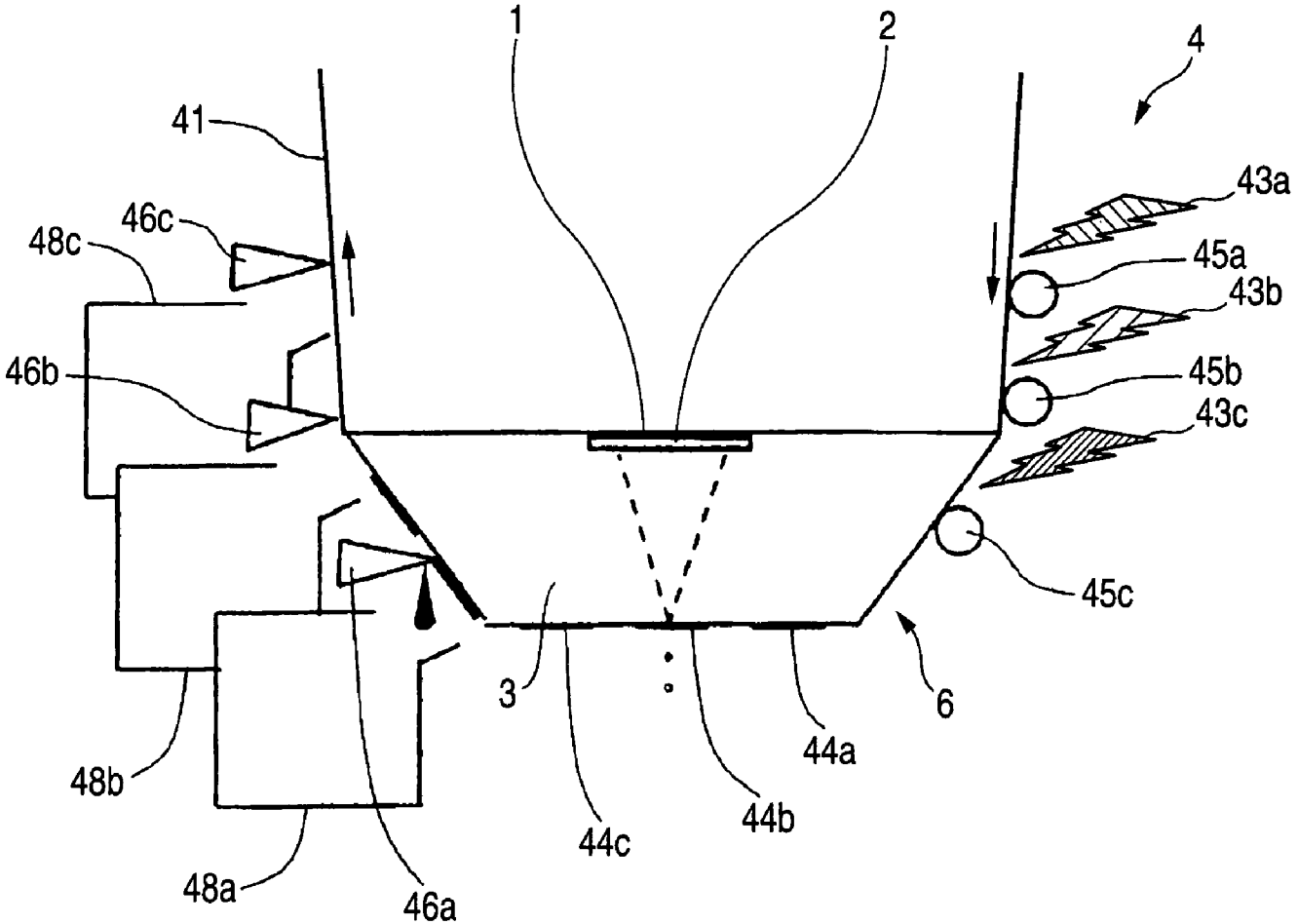
FIG. 10 is an enlarged cross-sectional view of a neighborhood of a head unit of the inkjet recording apparatus according to a fourth embodiment of the present invention.

A fourth embodiment of the inkjet recording apparatus of the present invention will be described by reference to FIG. 10. FIG. 10 is an enlarged cross-sectional view of a neighborhood of a head unit of an inkjet recording apparatus of the fourth embodiment. This embodiment is a modification of the third embodiment. Those elements which are identical with or analogous to those of the third embodiment are assigned common reference numerals, and their repeated explanations are omitted.

The ink layer adjustment unit 45 common to all types of ink in the third embodiment is provided for each type of ink in the present embodiment. A removable attachment mechanism is provided for ink layer adjustment units 45*a*, 45*b*, and 45*c* assigned to respective types of ink, whereby intrusion of impurities into each of the ink layers can be prevented without use of the cleaning unit.

In FIG. 10, the (three) scrapers 46*a*, 46*b*, and 46*c* in equal number to the types of ink are provided. However, in a modification, the recording apparatus can also be equipped with only one scraper by providing a scraper with a cleaning unit.

Fifth Embodiment

Figure 11:
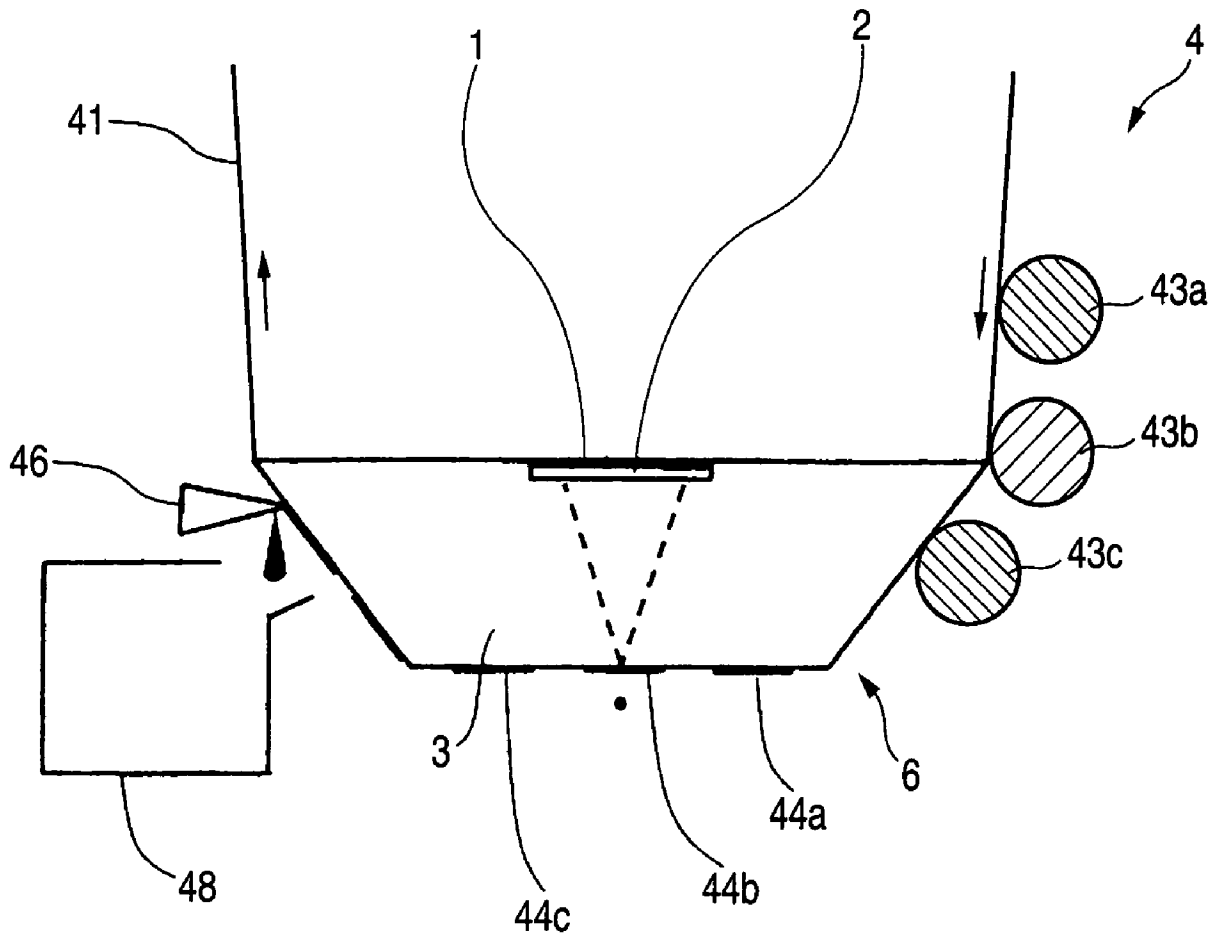
FIG. 11 is an enlarged cross-sectional view of a neighborhood of a head unit of the inkjet recording apparatus according to a fifth embodiment of the present invention.

A fifth embodiment of the inkjet recording apparatus of the present invention will be described by reference to FIG. 11. FIG. 11 is an enlarged cross-sectional view of the neighborhood of the head unit of the inkjet recording apparatus of the fifth embodiment. This embodiment is a modification of the third or fourth embodiment. Those elements which are identical with or analogous to those of the third or fourth embodiment are assigned common reference numerals, and their repeated explanations are omitted.

In the inkjet recording apparatus of the present embodiment, a hollow roller whose surface is made of a porous substance is used for the ink application units 43*a*, 43*b*, and 43*c*. Ink is supplied to the inside of the roller, and seeps through the surface of the roller and is applied over an exterior surface of the film 41. Control can be performed in such a way that mixing of ink does not a rise on the film 41, by providing the ink application rollers with a removable attachment mechanism.

FIG. 11 shows one recovered ink tank 48 and one ink recovery unit (scraper) 46. The ink recovered tank 48 may also be provided in numbers as shown in FIG. 5, or the recovered ink tank 48 and the ink recovery unit 46 may also be provided in numbers a shown in FIG. 10.

Utilizing a hollow roller whose surface is made of a porous material as an ink application unit, as in the present embodiment, is not limited to the case where a plurality of types of ink are used. Needless to say, the roller can be utilized as the ink application unit 43 described in connection with the first or second embodiment.

Moreover, even in the present embodiment, the ink layer adjustment unit for rendering uniform the ink layer 44 formed on the film 41 by the ink application units 43*a*, 43*b*, and 43*c* may also be provided additionally as in the case of the second embodiment or the fourth embodiment.

While the embodiments and the examples according to the invention have been described above, the invention is not restricted to such configurations but various changes can be made without departing from the technical thought of the invention.

What is claimed is:

1. An inkjet recording apparatus comprising:

a head unit including:

an ultrasonic wave generation unit that generates ultrasonic waves;

an ultrasonic wave focus unit that focuses the ultrasonic waves to an ultrasonic wave focus position;

an ultrasonic wave transmission unit that propagates the ultrasonic waves from the ultrasonic wave focus unit; and a wall plate that covers the ultrasonic wave generation unit, the ultrasonic wave focus unit and the ultrasonic wave transmission unit;

an annular film that rotates while sliding along an exterior of the head unit;

a film drive mechanism that rotates the film; and an ink application unit that applies ink over the film to form an ink layer, wherein the ultrasonic wave focus position of the head unit is directing to a position of the ink layer so as to eject an ink from the ink layer.

2. The inkjet recording apparatus according to claim 1, further comprising an ink layer adjustment unit that adjusts the thickness of the ink layer formed on the film by the ink application unit, the ink layer adjustment unit being disposed between a position where an ink layer is to be formed over the film and a position corresponding to the ultrasonic wave focus position.

3. The inkjet recording apparatus according to claim 1, further comprising an ink recovery unit that recovers an ink layer remaining on the film passed the ultrasonic wave focus position.

4. The inkjet recording apparatus according to claim 3, further comprising an ink recycle unit that recycles the ink recovered by the ink recovery unit by supplying the recovered ink to the ink application unit.

5. The inkjet recording apparatus according to claim 1, wherein viscosity of ink applied by the ink application unit is 100 mPa·s or more according to a measurement method specified by the International database for certified reference materials.

6. The inkjet recording apparatus according to claim 1, wherein the film drive mechanism includes a drive roller that rotates in contact with the film.

7. The inkjet recording apparatus according to claim 1, wherein the ultrasonic wave generation unit includes a piezoelectric element that is driven by electric power.

8. The inkjet recording apparatus according to claim 1, wherein the ink application unit applies a plurality of types of ink to different locations on the film.

9. The inkjet recording apparatus according to claim 8, wherein the ink layer adjustment unit individually adjusts the thickness of each of the ink layers of the plurality of types of ink applied over the film within an area between a position where ink is to be applied over the film by the ink application unit and a position corresponding to the ultrasonic wave focus position.

10. The inkjet recording apparatus according to claim 8, wherein the ink application unit applies the respective types of ink to be aligned along a rotating direction of the film while extending in the form of a strip.

11. The inkjet recording apparatus according to claim 8, wherein the ink application unit applies the respective types of ink to be aligned in a direction perpendicular to a rotating direction of the film while extending in the form of a strip.

12. The inkjet recording apparatus according to claim 8, wherein the ink application unit applies the respective types of ink to be aligned in a matrix pattern in both a rotating direction of the film and a direction perpendicular thereto.

* * * * *